US009017432B2

(12) United States Patent
Brooks et al.

(10) Patent No.: US 9,017,432 B2
(45) Date of Patent: Apr. 28, 2015

(54) PROCESS FOR DEMINERALISING COAL

(75) Inventors: Paul Brooks, Chatswood (AU); Alan Bruce Waugh, Goulburn (AU); Keith Norman Clark, Kenthurst (AU); Stephen Brian Weir, Charlestown (AU)

(73) Assignee: UCC Energy Pty Limited, North Sydney, New South Wales (AU)

( * ) Notice: Subject to any disclaimer, the term of this patent is extended or adjusted under 35 U.S.C. 154(b) by 1457 days.

(21) Appl. No.: 10/533,192

(22) PCT Filed: Oct. 23, 2003

(86) PCT No.: PCT/AU03/01409

§ 371 (c)(1),
(2), (4) Date: Oct. 7, 2005

(87) PCT Pub. No.: WO2004/039927

PCT Pub. Date: May 13, 2004

(65) Prior Publication Data

US 2006/0096166 A1 May 11, 2006

(30) Foreign Application Priority Data

Oct. 29, 2002 (AU) ..... 2002952315
Nov. 1, 2002 (AU) ..... 2002952446

(51) Int. Cl.
*C10L 9/02* (2006.01)
*C10L 5/36* (2006.01)
*C10L 9/08* (2006.01)

(52) U.S. Cl.
CPC . *C10L 5/366* (2013.01); *C10L 9/02* (2013.01); *C10L 9/086* (2013.01)

(58) Field of Classification Search
CPC ..... C10L 9/00; C10L 9/02; C10L 5/06
USPC ..... 44/620, 621–627
See application file for complete search history.

(56) References Cited

U.S. PATENT DOCUMENTS

| | | | | | |
|---|---|---|---|---|---|
| 4,134,737 | A | * | 1/1979 | Yang | 44/621 |
| 4,239,613 | A | | 12/1980 | Schulz | |
| 4,363,740 | A | * | 12/1982 | Curtis et al. | 510/317 |
| 4,424,062 | A | * | 1/1984 | Kamino et al. | 44/627 |
| 4,516,980 | A | * | 5/1985 | Wheelock | 44/624 |
| 4,582,512 | A | * | 4/1986 | Smit et al. | 44/627 |
| 4,618,346 | A | * | 10/1986 | Schapiro et al. | 44/624 |
| 4,695,290 | A | * | 9/1987 | Kindig et al. | 44/621 |
| 4,743,271 | A | * | 5/1988 | Kindig et al. | 44/621 |
| 4,936,045 | A | * | 6/1990 | Waugh et al. | 44/627 |
| 5,192,338 | A | * | 3/1993 | Waugh et al. | 44/627 |

FOREIGN PATENT DOCUMENTS

| | | |
|---|---|---|
| AU | 606607 B | 2/1991 |
| JP | 55-165995 | 12/1980 |
| JP | 62-59758 | 12/1987 |
| JP | 7-68531 | 7/1995 |
| JP | 7-108987 | 11/1995 |
| WO | WO 87/05621 | 9/1987 |
| WO | WO 89/01963 A1 | 3/1989 |

* cited by examiner

*Primary Examiner* — Prem C Singh
*Assistant Examiner* — Ming Cheung Po
(74) *Attorney, Agent, or Firm* — Stinson Leonard Street LLP

(57) ABSTRACT

A process for demineralizing coal includes the steps of forming a slurry of coal particles in an alkali solution, the slurry containing 10-30% by weight coal, maintaining the slurry at a temperature of 150-250° C. under a pressure sufficient to prevent boiling, separating the slurry into an alkalized coal and a spent alkali leachant, forming an acidified slurry of the alkalized coal, the acidified slurry having a pH of 0.5-1.5, separating the acidified slurry into a coal- containing fraction and a substantially liquid fraction, subjecting the coal-containing fraction to a washing step, particularly a hydrothermal washing step, in which the coal-containing fraction is mixed with water and a polar organic solvent or water and an organic acid to form a mixture and separating the coal from the mixture. The demineralized coal has an ash content of from 0.01-0.2% by weight and can be used a feed to a gas turbine.

44 Claims, 4 Drawing Sheets

PROCESS FOR DEMINERALISING COAL

FIELD OF THE INVENTION

The present invention relates to a process for demineralizing coal.

BACKGROUND OF THE INVENTION

Several methods have been described in the literature for producing demineralized or low-ash coal for fuel and other industrial applications, but none have achieved sustained commercial use.

A process was developed in Germany during the 1940's for removing ash-forming mineral matter from physically cleaned black coal concentrates, involving heating the coal as a paste with aqueous alkali solution, followed by solid/liquid separation, acid washing and water washing steps. Reports on this process detail a practical chemical demineralizing method. German practice showed that a demineralized coal with an ash yield of 0.28% could be produced from a physically cleaned feed coal which had an initial ash yield of 0.8%.

The coal-alkali feed paste was stirred at 40°-50° C. for 30 minutes, then pumped through a heat exchanger to a continuously operable gas-heated tubular reactor in which the paste was exposed to a temperature of 250° C. for 20 minutes, under a pressure of 100-200 atmospheres (10-20 MPa). The reaction mixture was then passed through the heat exchanger previously mentioned, in order to transfer heat to the incoming feed, then cooled further in a water-cooled heat exchanger.

The cooled paste was diluted with softened water, then centrifuged to separate and recover the alkaline solution and the alkalized coal. The latter was dispersed to 5% hydrochloric acid, then centrifuged to recover the acidified coal and spent acid and redispersed in water. The coal was filtered from this slurry, dispersed again in another lot of water and centrifuged to recover the resulting low-ash coal as a damp solid product.

American and Indian researchers used broadly similar chemical methods, with variations in processing details, to produce low-ash coals from other feed coals, most of which had much higher starting ash levels than the coals than the Germans used. Another American group (at Battelle) claimed advantages for:

(a) Mixed alkali leachants containing cations from at least one element from Group IA and at least one element from Group IIA of the Periodic Table;

(b) Filtration or centrifugation of the alkalized coal from the spent alkaline leachant, either at the reaction temperature or after rapid cooling to less than 100° C., in order to minimise the formation of undesired constituents, presumably sodalite or similar compounds;

(c) Application of the process to low-rank coals which dissolve in the alkali and which can be reprecipitated at a different pH from the mineral matter, thus allowing separation and selective recovery.

Other researchers had studied scientific aspects of alkaline extraction of sulphur and minerals, including the relative merits of different alkalis. Most American work has been directed at the removal of sulphur rather than metallic elements, and the acid treatment step is often omitted. However, an American group (at Alcoa) has chemically cleaned coal to less than 0.1% ash yield, concurrently achieving large reductions and low final concentrations of iron, silicon, aluminium, titanium, sodium and calcium. The aim was to produce very pure coal suitable for conversion into electrode carbon for the aluminium industry. This was achieved by leaching powdered coal with hot aqueous alkaline solution under pressure (up to 300° C.), then successively with aqueous sulphuric acid and aqueous nitric acid at 70°-95° C.

Australian patent no. 592640 (and corresponding U.S. Pat. No. 4,936,045) describes a process for the preparation of demineralized coal. This process includes the following steps:

(a) forming a slurry of coal particles, preferably at least 50% by weight of which particles have a maximum dimension of at least 0.5 mm, with an aqueous solution of an alkali, which solution has an alkali content of from 5 to 30% by weight, such that the slurry has an alkali solution to coal ratio on a weight basis of at least 1:1;

(b) maintaining the slurry at a temperature of from 150° to 300° C., preferably 170° C. to 230° C., for a period of from 2 to 20 minutes substantially under autogenous hydrothermal pressure and rapidly cooling the slurry to a temperature of less than 100° C.;

(c) separating the slurry into alkalized coal and a spent alkali leachant solution;

(d) regenerating the alkali leachant solution for reuse in step (a) above by the addition of calcium or magnesium oxide or hydroxide thereto to precipitate minerals therefrom;

(e) acidifying the alkalized coal by treatment with an aqueous solution of sulphuric or sulphurous acid to yield a slurry having a pH of from 0.5 to 1.5 and a conductivity of from 10,000 to 100,000 μs;

(f) separating the slurry into acidified coal and a spent acid and a spent acid leachant solution; and (g) washing the acidified coal.

Although the process described in Australian patent no. 592640 can produce a demineralized coal product having on ash content of less than 1% by weight and as low as 0.50% by weight, significant opportunities arise if the ash content can be reduced to even lower levels. If the ash level can be reduced to levels even lower than that achieved in Australian patent no. 592640, the demineralized coal product may be used as a fuel directly fired into a gas turbine. In this use, the demineralized coal could replace natural gas as a fuel for the gas turbine. Such demineralized coal could also be used as an alternative to heavy fuel oils and as a high purity carbon source for the production of metallurgical recarbonisers, carbon electrodes for aluminium production and alternative reductants for high purity silicon manufacture. The contents of U.S. Pat. No. 4,936,045 are herein incorporated by cross-reference.

SUMMARY OF THE INVENTION

In a first aspect, the present invention provides a process for demineralizing coal comprising:

(a) forming a slurry of coal particles in an alkali solution, (b) maintaining the slurry at a temperature of 150-250° C. under a pressure sufficient to prevent boiling;

(c) separating the slurry into an alkalized coal and a spent alkali leachant;

(d) forming an acidified slurry of the alkalized coal, said acidified slurry having a pH of 0.5-1.5;

(e) separating the acidified slurry into a coal-containing fraction and a substantially liquid fraction;

(f) subjecting the coal-containing fraction to a washing step in which the coal-containing fraction is mixed with water and a polar organic solvent or water and an organic acid to form a mixture; and (g) separating the coal from the mixture in step (f).

The coal that is provided to step (a) is suitably a medium to high rank coal, most suitably a bituminous coal.

The coal that is provided to step (a) preferably has a total mineral content generally in the range of 2-15% by weight. More preferably, the mineral content of the coal should be as low as possible. It has been found that the chemical consumption and hence the processing cost is lower for coals of low ash content fed to step (a) of the process.

It is preferred that the coal that is provided to step (a) of the process of the present invention is sized such that 100% is less than 1 mm, more preferably 100% less than 0.5 mm. The coal also preferably contains a minimum of material less than 20 microns, more preferably less than 5% by weight smaller than 20 microns. It has been found that excess amounts of fine material, e.g, less than 20 microns, can cause difficulties in the solid/liquid separation steps used in the present invention.

Steps (a) and (b) of the present process subject the coal to an alkali (or caustic) digestion. This results in the silicate minerals, including clays, being solubilized with some re-precipitating as acid soluble minerals.

The slurry formed in step (a) suitably has a coal concentration of from 10% to 30% by weight. Preferably, the coal concentration is about 25% by weight.

The alkali concentration in the liquid phase of the slurry is preferably in the range of 8% to 20% by weight, more preferably 13% to 15% by weight (calculated as NaOH equivalent). The alkali material is preferably NaOH, although other alkali materials could also be used, either singly or as a mixture of two as more alkali materials. The slurry is suitably heated to a temperature of from 150-250 C., more preferably from 220-250° C. The slurry is preferably maintained at this temperature for a period of from 15 to 60 minutes, more preferably for about 20 minutes.

It has been found that the rate of heating the slurry should preferably be maintained at a rate of less than 2° C. per minute in the temperature range of 150° C. to 250° C.

It is preferred in steps (a) and (b) that the caustic slurry is formed and then heated to the desired temperature.

The slurry in step (b) is suitably maintained at the autogenous pressure of the heated slurry to prevent the slurry from boiling.

It is also preferred that the slurry be subject to agitation, especially mild agitation, in step (b). The degree of agitation is preferably such that deposition of sodium aluminosilicates, of which one form is sodalite ($Na_4Si_3Al_3O_{12}(OH)$), on the process vessel walls is minimised or avoided. Agitation may be achieved by any suitable agitation means known to the person of skill in the art. Alternatively or in combination, the use of recycled caustic solution containing small seed crystal of sodium aluminosilicates can be used to encourage sodium aluminosilicates crystal growth in the slurry rather than on the process vessel walls.

Step (c) of the process of the present invention separates the caustic slurry from step (b) into an alkalized coal and a spent alkali leachant. This separation step preferably takes place at a temperature of from 30° C. to 80° C. It is especially preferred that the slurry from step (b) is cooled at a cooling rate of less than 20° C./minute more preferably less than 5° C./minute, even more preferably less than 2° C./minute whilst the temperature of the slurry is in the range of 240° C.-150° C.

Step (c) may suitably comprise a filtration step. As mentioned above, the filtration step preferably is conducted at a temperature of from 30° C. to 80° C.

The spent caustic/leachant from step (c) is preferably treated to regenerate caustic and recover minerals. For example, the spent leachant may be mixed with sufficient calcium oxide or calcium hydroxide to precipitate the soluble silicate and aluminate ions as their insoluble calcium salts, while simultaneously forming soluble sodium hydroxide, thus regenerating the alkaline leachant for recycling. Instead of calcium oxide or hydroxide, the corresponding magnesium salts may be used, or the mixed oxides or hydroxides of calcium and magnesium derived from dolomite may be used.

The alkalized coal recovered from step (c) is preferably washed to remove excess alkali. The coal is preferably washed with a minimum of 3 parts by weight of water for each part by weight of dry coal, more preferably 5 parts by weight water for each part by weight of dry coal.

The alkalized coal from step (c) may also be treated to remove sodium aluminosilicates such as sodalite therefrom prior to sending to the acid soak step. The sodalite may be separated from the alkalized coal by physical methods such as selective screening, heavy media float-sink methods, or froth flotation. The sodium aluminosilicates, such as sodalite, may provide a valuable by-product whilst removal thereof reduces the amount of acid required in step (d).

Step (d) of the process of the present invention may suitably involve mixing the coal from step (c), more preferably washed coal from step (c), with water or an acid solution to obtain a slurry. The slurry preferably has a coal concentration that falls within the range of 5% to 20% by weight, more preferably about 10% by weight. Generally, the greater the ash content of the starting coal the lower the coal concentration in the acid slurry, with a 10% slurry being suitable for a starting coal with an ash level of approximately 9%. If the slurry is formed by mixing with water, it may be suitably acidified by mixing it with an acid.

Step (d) preferably forms a slurry that contains a mineral acid, more preferably sulphuric acid or hydrochloric acid.

The acidified slurry has a pH that falls in the range of 0.5 to 1.5, more preferably pH about 1.0.

The temperature of the slurry in step (d) preferably falls within the range from 20° C. to 90° C., more preferably from 30° C. to 60° C.

The slurry may be suitably agitated in the acid solution.

The coal is preferably maintained in contact with the acid solution in step (d) for a period of at least 1 minute, more preferably for at least 20 minutes, even more preferably about 60 minutes.

In one embodiment of the present invention, after an appropriate time, the coal in the slurry of step (d) is separated in step (e) and passed to step (f). In a more preferred embodiment, the coal fraction from step (e) is re-slurried with water and acid and brought to a pH of between 0.5 and 1.0, more preferably about pH 0.5, for a further period of time of greater than 1 minute. In the more preferred embodiment the first acid treatment will be with a pH of 1.0-1.5 for the minimum time sufficient to achieve essentially complete sodium aluminosilicate dissolution. The second acid treatment is preferably at a pH of 0.5-1.0 for times between 10 minutes and 3 hours.

The step of re-slurrying the coal may be repeated between one and four times. Fresh acid solution may be used for the re-slurrying.

Alternatively, the re-slurrying may comprise a countercurrent mixing stage.

Step (e) involves separating the acidified slurry into a coal-containing fraction and a liquid fraction. This may be achieved using any suitable solids/liquid separation means known to the skilled person. Filtration is preferred. If the filtercake is to be re-slurried with acid, it does not require washing so long as the time between step (e) and the second acid treatment is kept to a minimum, preferably less than 5 minutes. After the final stage of acid re-slurrying, the filtercake may be given a minimal water wash such that when the filtercake is re-slurried in fresh water, the pH of the solution is preferably about 2.

The spent acid may be treated to regenerate an alkali solution and to obtain the controlled precipitation of minerals as by-products. For example, the spent acid may be treated with calcium oxide to regenerate a caustic solution and precipitate the minerals.

The wash step of step (f) involves two possible options. One of these is to mix the coal from the last of the acid soak steps with a solution of water and a polar organic solvent. The polar organic solvent is suitably miscible with water. The polar organic solvent is preferably an alcohol, more preferably ethanol, although methanol and propanol may also be used.

The coal is preferably mixed with the solution of water and polar organic solvent such that a slurry having a solids content of 10-30% by weight, more preferably about 25% by weight. The residual acidity from the acid soak step(s) is preferably such that the pH of the slurry is from 1.5 to 2.5, and more preferably about 2.0.

The slurry is preferably heated to a temperature of from 240° C. to 280° C., more preferably 260° C. to 270° C., in step (f). The slurry is preferably kept at temperature for a period of between 1 minute and 60 minutes, more preferably about 5 minutes.

The slurry of coal/water/polar organic solvent is preferably heated at a heating rate of between 2° C. per minute and 20° C. per minute.

The pressure of the slurry is such that boiling is prevented. The slurry is preferably heated under autogenous pressure. At the preferred temperature specified above, the autogenous pressure is approximately 8 MPa.

As mentioned above, the presently preferred polar organic solvent is ethanol. It is especially preferred that the liquid phase mixed with the coal to produce the slurry is a 50% by weight ethanol in water solution Option 1 of the washing stage reduces the level of the Na, Si, Fe and Ti, but it is primarily active in reducing Na and Si. If only Na is required to be reduced, the temperature used in the wash stage can be as low as 10° C., with operation at ambient temperature being especially suitable.

The second option for the washing stage involves mixing the coal from the acid soak step(s) with an aqueous solution of an organic acid. Citric acid is presently the preferred organic acid, with chloroacetic acid, malonic acid and malic acid also being able to be used.

The citric acid solution preferably contains between 5% and 20% by weight citric acid (hydrated basis), more preferably about 10% by weight. The coal concentration in the slurry is preferably in the range of 10% to 30% by weight, more preferably about 25% by weight. The slurry is preferably heated to a temperature of between 240° C. to 280° C., more preferably between 250° C. to 270° C. The pressure should be maintained at a level sufficient to prevent boiling. The pressure is suitably the autogenous pressure which, for the temperature range specified above, is approximately 8 MPa. The slurry is preferably kept at the elevated temperature for a period of between 1 minutes and 60 minutes, more preferably about 5 minutes. The slurry is preferably heated to the elevated temperature at a heating rate of between 2° C. per minute and 20° C. per minute.

In another embodiment of the second option, the slurry may be heated to a temperature of between 150° C. and 160° C. In this embodiment, Na and Fe will not be removed.

When step (f) is conducted at elevated temperature, it constitutes a hydrothermal wash step.

Without wishing to be bound by theory, the present inventors have postulated that two mechanisms may be taking place in the washing step to further reduce the ash content, these being:

(i) the residual acid in the coal from the acid soak step(s) results in the slurry of step (d) being acidified, eg, to a pH of between 1.5 and 2.5. This promotes further mineral dissolution;

(ii) it is thought that humic compounds are formed by interaction between the coal and the alkali in steps (a) and (b). In the acid soak step(s), these humic compounds "collapse" and tie up some of the Na. In the washing step, option 1, the alcohol allows the humics to hydrolyse to release the Na. The Na reports to the water phase following alcohol/water separation. The alcohol can be recycled, essentially in a closed loop recycling step, thus minimising alcohol consumption. In option 2, the citric acid facilitates release of the Na from the humics.

Still without wishing to be bound by theory, an alternative mechanism postulated by the inventors is that the Na is scattered amongst functional groups and also incorporated into the coal structure, especially the graphitic structures. This is borne out by the higher residual Na found in processed higher rank coals, which have fewer humic/functional groups but an increased proportion of graphitic structures.

It is suggested that the Na is bound to and/or trapped within the coal structure, and that the ethanol swells the structure and allows the Na to migrate out, or in the case of functional groups (lower rank coals), participates in an esterification reaction. Organic acids, such as citric acid, would have incomplete dissociation in water, so that the dissolved yet undissociated citric acid molecules also swell the coal. Heat also helps to give the Na the kinetic energy to escape any bonds holding it to the coal. Diffusion of the Na out of the coal structure is also believed to play a part.

Step (g) of the process of the present invention involves separating the coal from the mixture or slurry in step (f). This solid/liquid separation may be achieved by any means known to be suitable by a person of skill in the art. Filtration is preferred.

It is preferred that the coal recovered from step (g) be washed. Preferably the washing uses a minimum of one part of clean water for each part of coal, by weight.

The process in accordance with the first aspect of the present invention can produce a demineralised coal product having an ash content of from 0.01-0.2%, by weight. The process also removes Na and Si from the coal and thus by lowering the Na content the ash fusion temperature of the ash remaining in the coal is also advantageously increased by the process. The ash fusion temperature is important if the demineralised coal is to be used as a fuel for gas turbines as these require that the ash fusion temperature be greater than 1350° C., more preferably greater than 1500° C.

The process of the first aspect of the present invention is capable of achieving demineralised coal having an ash content of less than 0.2% by weight preferably from 0.01% to 0.2% by weight, with trials involving some coals achieving an ash content of 0.01% by weight. Steps (a) to (e) of this process of the first aspect of the invention are capable of producing a demineralised coal having an ash content as low as 0.3-0.4% by weight. For some uses, this ash content is acceptable and the further processing of the washing step may not be necessary.

Accordingly, in a second aspect, the present invention provides a process for demineralising coal comprising steps (a) to (e) of the process described with reference to the first aspect of the present invention.

The washing stage has also been shown to reduce the ash content of the coal. This also suggests that the washing stage can be used as a stage in a demineralisation process that includes steps other than steps (a) to (e) as described with reference to the first aspect of the present invention.

Accordingly, in a third aspect, the present invention provides a process for demineralising coal comprising the steps of alkali digestion followed by acid soaking and wherein coal from the acid soaking step is subjected to a further step as described with reference to step (f) of the first aspect of the present invention.

The demineralised coal may be subjected to a binderless briquetting process to form a final product of enhanced handleability.

DETAILED DESCRIPTION OF THE DRAWINGS

In considering the drawings, it will be appreciated that the drawings are provided for the purposes of illustrating preferred embodiments of the invention. Therefore, the invention should not be considered to be limited to the features shown and described with reference to the drawings.

Figure 1:
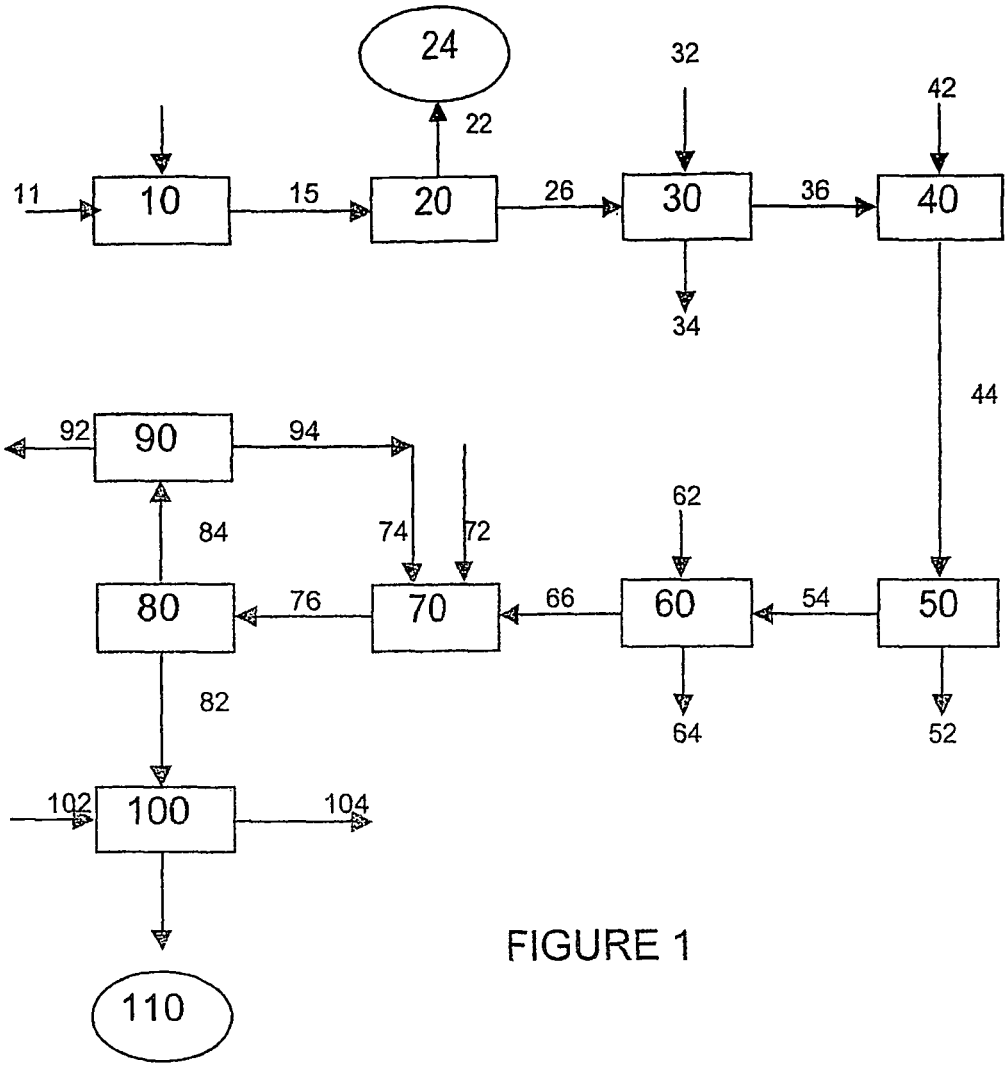
FIG. 1 is a process flowsheet of an embodiment of a process for demineralising coal in accordance with the first aspect of the invention.

A flow sheet for a demineralisation process in accordance with the present invention is shown in FIG. 1. In FIG. 1, a slurry 11 of coal and caustic solution is fed to a caustic digestion vessel 10. Caustic digestion vessel 10 is suitably an autoclave or a pressure vessel that allows the slurry of caustic solution and coal to be heated.

The caustic solution 12 that is fed to caustic digestion vessel 10 comprises a sodium hydroxide solution having a sodium hydroxide concentration of 13 to 15%. The coal 11 and sodium hydroxide solution 12 are fed to caustic digestion vessel 10 in amounts such that a slurry containing 25% coal is achieved.

The slurry of coal and caustic solution in vessel 10 is heated to a temperature of from 150-250 C, more preferably from 220 to 250° Celsius. The slurry is maintained at this temperature for a period from 1 minute to 60 minutes, with 20 minutes being especially suitable. The slurry is maintained under autogenous pressure so that the solution does not boil.

The slurry of caustic solution and coal is heated such that the rate of increase of temperature does not exceed 2° Celsius per minute when the temperature of the coal falls within the temperature range of 150 to 240° Celsius.

After the required residence time has passed, the slurry is cooled at a cooling rate of less than 20 C. per minute, more preferably less than 5° Celsius per minute, even more suitably less than 2° Celsius per minute, whilst the temperature is in the range of 240 to 150° Celsius. The slurry is removed from caustic digestion vessel 10 and passes via line 15 into filtration unit 20. Filtration unit 20 may be any suitable filtration unit that can achieve separation of coal from the caustic solution. Belt filters and drum filters are especially useful. It will also be appreciated that other solid/liquid separation devices may be used in place of filtration unit 20. For example, thickeners or decanters may be used.

The spent caustic solution 22 recovered from filtration unit 20 is sent to caustic recovery 24. In caustic recovery 24, the spent caustic solution is regenerated. For example, the spent caustic solution may be contacted with calcium oxide, calcium hydroxide, magnesium oxide or magnesium hydroxide to precipitate minerals therefrom and regenerate sodium hydroxide. The regenerated sodium hydroxide can be reused.

The alkalised coal 26 is then washed with water in water wash vessel 30. Water wash vessel 30 may be any suitable vessel for mixing liquids and solids. Alternatively, and preferably, water wash 30 is effected by washing the filter cake on the filtration unit 20. In this regard, if a belt filter is used, a filter cake comprising alkalised coal and residual caustic solution is formed on the filter belt. This filter cake may be sprayed with wash water 32. As the filter cake is still in contact with the filtration unit, the wash water is removed as removed wash water 34. The wash water 34 may also be sent to caustic regeneration 24.

The washed filter cake, comprising washed alkalised coal 36, is then fed to the acid soak process 40. In the acid soak process 40, alkalised coal from filtration unit 20 and water wash 30 is mixed with water to give a slurry concentration in the range of 5 to 25% by weight coal, preferably 10% by weight coal. The slurry is acidified with acid 42, preferably sulfuric acid, to obtain a pH in the range of from 0.5 to 1.5, preferably pH 1.0. The temperature of the acid slurry is maintained in the range of 20° to 90° C., more suitably in the range of 30° to 60° Celsius, for a period of greater than 1 minute, more preferably greater than 20 minutes. It has been found that 60 minutes is a suitable time for maintaining the coal in contact with the acid solution. The coal should be agitated to promote mixing of the coal with the acid solution.

Figure 2:
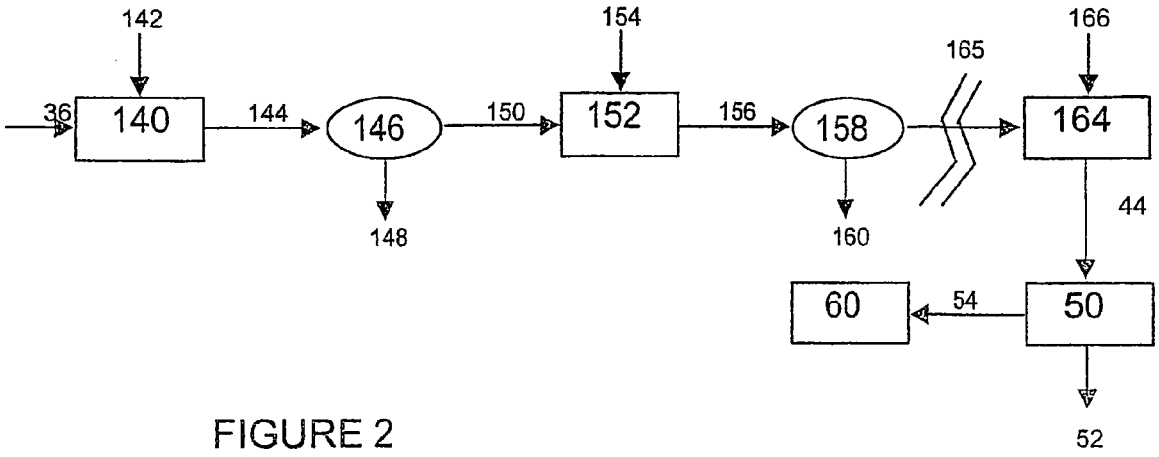
FIG. 2 is a process flowsheet of one embodiment of the acid soak step of FIG. 1.
Figure 3:
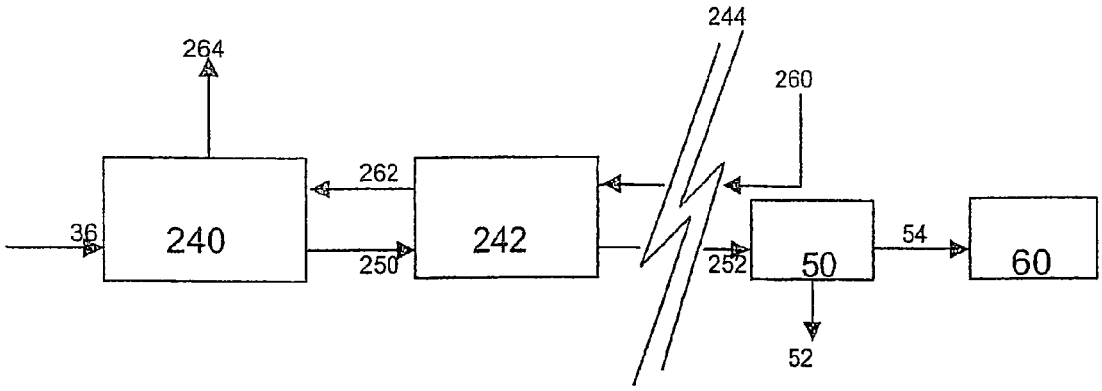
FIG. 3 is a process flowsheet of an alternative embodiment of the acid soak step of FIG. 1.

The acid wash soak process 40 may comprise a single contact between the acid solution and the coal. However, it is preferred that the acid soak process involves contacting the coal with acid solution more than once. Preferably, the coal is contacted with the acid solution under the conditions of temperature and residence time outlined above. The coal and acid solution are then separated and the coal further contact with acid solution on one or more occasions. FIGS. 2 and 3 show schematic diagrams of some possible embodiments of the acid soak process 40.

After the acid soak process 40, the coal and acid solution are separated in separation unit 50. Separation unit 50 is suitably a filtration unit, especially a belt filter or a drum filter. The spent acid solution 52 is removed.

The recovered coal 54 is then subjected to a water wash 60. Water wash 60 is suitably achieved by spraying the filter cake of the belt filter or the drum filter with a wash water 62. The wash water is removed from the filter cake through the filtration unit, and the removed wash water is shown as reference numeral 64.

The washed filter cake 66, which comprises treated coal and a small amount of residual acid solution, is then passed to hydrothermal washing process 70. The washed coal 66 that is provided to hydrothermal washing process 70 has residual acid present in an amount such that when the washed coal 66 is reslurried in fresh water, the pH of the liquid phase will be approximately 2.

In hydrothermal washing process 70, water 72 and ethanol 74 are mixed with the coal. Preferably, the water and ethanol are mixed such that a solution of 50% ethanol in water is obtained. The amount of water, ethanol and coal fed to the hydrothermal washing process 70 is such that a slurry having a solids loading of 25% by weight is achieved. Suitably, the water, ethanol and coal are mixed prior to feeding to vessel 70.

In a most preferred embodiment of the present invention, the slurry in hydrothermal washing process 70 is heated to a temperature of 240 to 280° Celsius, especially 260 to 270° Celsius, by heating the slurry at a heating rate of between 2° Celsius per minute and 20° Celsius per minute. Heating is conducted under autogenous pressure such that boiling is prevented. At the maximum temperatures reached in the hydrothermal washing process 70, the autogenous pressure is approximately 8 MPa. The slurry is suitably kept at the elevated temperature for a period of between 1 minute and 60 minutes, suitably 5 minutes. Under these conditions, the hydrothermal washing process reduces the level of sodium, silicon, iron and titanium in the coal, with the primary activity being reduction of sodium and silicon levels.

If only sodium is required to be reduced in hydrothermal washing process 70, the temperature used the hydrothermal wash stage can be as low as 10° Celsius and is suitably ambient temperature. In this case, the hydrothermal washing stage can be simply described as a washing stage.

The slurry from hydrothermal washing process 70 is passed via line 76 to filtration unit 80. In filtration unit 80, the slurry from the hydrothermal washing process is separated into a coal fraction 82 and a liquid fraction 84. The liquid fraction 84 may be sent to an ethanol recovery unit 90, which is suitably a distillation column. In ethanol recovery unit 90, the liquid fraction 84 is split into a water rich fraction 92 and an ethanol rich fraction 94. Ethanol rich fraction 94 is suitably returned as stream 74 to the hydrothermal washing unit 70.

The coal fraction 82 is washed in washing process 100 using fresh wash water 102. The wash water is removed via stream 104 and a recovered ultra clean coal product 110 is recovered.

The ultra clean coal product is preferably subjected to a binderless briquetting process to produce a product having enhanced storage and transport properties.

The ultra clean coal product recovered from the process shown in FIG. 1 will typically have an ash content of between 0.01 and 0.2% by weight, with an ash fusion temperature sufficiently high to enable use of the ultra clean coal as a fuel for gas turbines. When the ultra clean coal is used to fire directly into gas turbines as part of a gas turbine combined-cycle power station, the ultra clean coal has the potential to reduce the greenhouse gas emissions by 25% when compared to modern coal fired thermal power stations. When the extra processing involved in obtaining the ultra clean coal is taken into account, greenhouse gas emissions are still reduced by nearly 10% on an overall life-cycle basis.

As mentioned above, the acid soak process 40 may comprise a first slurrying of the coal with an acid solution, followed by re-slurrying of the coal between one and four times. FIG. 2 shows one possible flow sheet for the acid soak process 40. In FIG. 2, the alkalised coal 36 is fed to a first acid soak vessel 140. An acid solution 142 is mixed with the alkalised coal 36 in vessel 140 for the desired time and under the desired temperature conditions. The acidified slurry of coal 144 then passes to a separator 146. The spent acid solution 148 is removed and the coal containing fraction 150 is thereafter fed to second acid soak vessel 152. Spent acid solution may be sent to caustic recovery step 24 for NaOH regeneration and recovery of minerals. Fresh acid solution 154 is mixed with the coal containing fraction in vessel 152 under the required conditions. The acidified slurry 156 is sent to second separator 158. The acid solution 160 is removed and the coal containing fraction 162 sent to either separation unit 50 as shown in FIG. 1 or, if further is re-slurrying steps are required, sent to a further acid soak vessel 164. Broken lines 165 indicate that the sequence of soaking with fresh acid solution followed by separation may be repeated one or more times.

In vessel 164, the coal containing fraction 162 is mixed with fresh acid solution 166 for the desired time and under the desired conditions. The removed slurry 44 (which corresponds to slurry line 44 shown in FIG. 1) is then passed to separator 50 and water wash 60, which correspond to the respective separator 50 and water wash 60 of FIG. 1.

The re-slurrying of the coal with fresh acid solution preferably takes place between one and four times.

FIG. 3 shows an alternative embodiment of the acid soak process in which a number of contacts are made between the acid solution and the coal fraction. In FIG. 3, the acid soak process is achieved by a multi stage, counter current contacting between the coal and the acid solution. The process involves contacting the coal fraction with the acid solution in a number of contacting vessels 240, 242. The broken lines 244 indicate that there may be more contacting vessels than the two shown in FIG. 3. The coal 36 is fed to contacting vessel 240. The coal containing fraction 250 from vessel 240 is fed to contacting vessel 242. The coal containing fraction 252 from contacting vessel 240 is then fed to either separation unit 50 (as shown in FIG. 1) or to one or more further contacting vessels (not shown).

Similarly, fresh acid solution 260 is fed to the downstream contacting vessel (242 in FIG. 3). The liquid fraction from 262 from vessel 242 is then fed to contacting vessel 240. The liquid fraction 264 from contacting vessel 260 is removed. The spent acid 264 may be sent to caustic regeneration (eg 24 in FIG. 1) to regenerate an NaOH solution and recover precipitated minerals.

The process shown in FIG. 3 may utilise any apparatus known to be suitable to the man skilled in the art for counter current contact between solids and liquids. Such apparatus will be well known and need not be described further.

Figure 4:
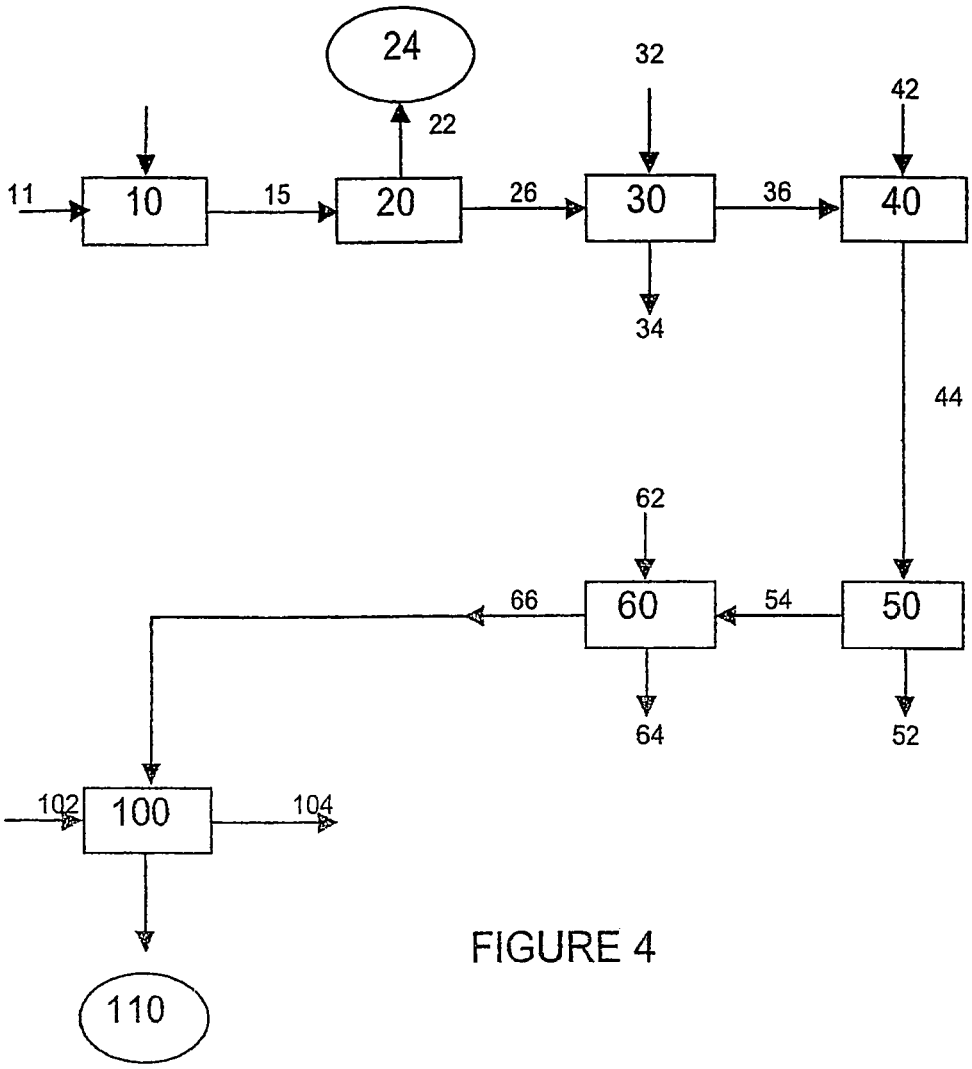
FIG. 4 is a process flowsheet of an embodiment of a process for demineralising coal in accordance with the second aspect of the invention.

FIG. 4 shows a flow sheet of a process in accordance with the second aspect of the present invention. For some uses, the coal product obtained from water wash 60 shown in FIG. 1 has sufficiently low ash content to be used without needing to undergo the hydrothermal washing process. Therefore, the process shown in FIG. 4 is essentially identical to that shown in FIG. 1, except that the coal fraction 66 from water wash 60 is not fed to the hydrothermal washing process, but rather goes to water wash 100, where it is washed with wash water 102 to obtain an ultra clean coal product 110. The ultra clean coal product 110 of FIG. 4 will have a somewhat higher ash content that the ultra clean coal product 110 of FIG. 1.

The remaining features of the process shown in FIG. 4 are essentially identical to those of FIG. 1 and the same reference numerals have been used in FIG. 4 for those features.

Figure 5:
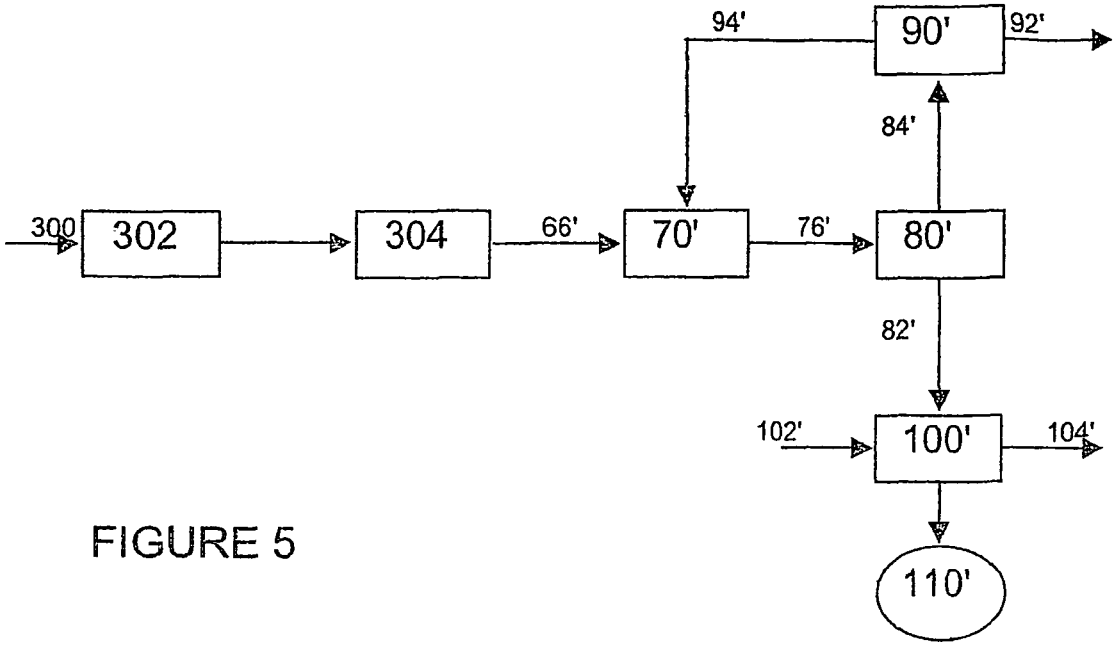
FIG. 5 is a process flowsheet of an embodiment of a process for demineralising coal in accordance with the third aspect of the invention.

FIG. 5 shows a flow sheet in accordance with the third aspect of the invention. In the flow sheet shown in FIG. 5, the coal 300 is subjected to a caustic digestion 302, and then to an acid wash or acid soak stage 304. The caustic digestion 302 and acid wash stage 304 of FIG. 5 may be the same or different to the respective stages described with reference to FIG. 1. The coal fraction 66' from acid soak 304 is fed to a hydrothermal washing process 70', followed by separation in filtration unit 80' into a liquid fraction 84' and a coal containing fraction 82'. Liquid fraction 84' is fractionated into a water containing fraction 92' and a recovered ethanol fraction 94'.

Coal containing fraction 82' is washed in washing unit 100' and an ultra clean coal product 100' is recovered. The processing steps and conditions of hydrothermal washing process 70' shown in FIG. 5 is essentially identical to the hydrothermal washing process 70 with reference to FIG. 1.

Those skilled in the art will appreciate that the invention described herein may be subject to variations and modifications other than those specifically described. It is noted that the hydrothermal washing process may use an organic acid instead of the polar organic solvent, with citric acid being preferred. If citric acid is used in the hydrothermal washing process, the preferred conditions are as set out under the description of the first aspect of the present invention and the ethanol recovery process may be omitted.

The particular apparatus used in the present process includes any suitable apparatus known to the person skilled in the art. For example, the caustic digestion vessel 10 may comprise any suitable reactor including tubular concurrent-flow reactors, stirred autoclaves operating batch wise, or with continuous inflow and outflow, in single or multi stage configurations, or counter current or cross phase systems. As the apparatus that may be used in the process of the present invention will be well known to the person of skill in the art, it need not be described further.

It will be understood that the invention disclosed and defined herein extends to all alternative combinations of two or more of the individual features mentioned or evident from the text or drawings. All of these different combinations constitute various alternative aspects of the invention.

The invention claimed is:

1. A process for demineralizing coal comprising:

(a) forming a slurry of coal particles in an alkali solution;

(b) maintaining the slurry at a temperature of 150-250° C. under a pressure sufficient to prevent boiling;

(c) separating the slurry into an alkalized coal and a spent alkali leachant;

(d) forming an acidified slurry of the alkalized coal, said acidified slurry having a pH of 0.5-1.5;

(e) separating the acidified slurry into a coal-containing fraction and a substantially liquid fraction;

(f) subjecting the coal-containing fraction to a hydrothermal washing step to remove Si, Fe and/or Ti from the coal comprising:

(1) mixing the coal-containing fraction with water and (a) a polar organic solvent or (b) citric acid to form a mixture, and (2) heating the mixture to a temperature of from 150° C. to 280° C. under a pressure sufficient to prevent boiling, wherein the mixture is maintained at said temperature of from 150° C. to 280° C. at said pressure for a period of between 1 minute and 60 minutes; and (g) separating the mixture of step (f) into a liquid portion containing Si, Fe and/or Ti and a coal containing portion.

2. A process as claimed in claim 1 wherein the coal provided to step (a) is sized such that 100% is less than 1 mm.

3. A process as claimed in claim 2 wherein the coal provided to step (a) is sized such that 100% less than 0.5 mm.

4. A process as claimed in claim 2 wherein the coal provided to step (a) contains 5% by weight smaller than 20 microns.

5. A process as claimed in claim 1 wherein the slurry formed in step (a) has a coal concentration of from 10% to 30% by weight.

6. A process as claimed in claim 5 wherein the coal concentration in the slurry is about 25% by weight.

7. A process as claimed in claim 1 wherein an alkali concentration in a liquid phase of the slurry is in the range of 8% to 20% by weight (calculated as NaOH equivalent).

8. A process as claimed in claim 7 wherein the alkali concentration is from 13% to 15% by weight (calculated as NaOH equivalent).

9. A process as claimed in claim 1 wherein the slurry is heated to a temperature of from 220-250° C. in step (b).

10. A process as claimed in claim 1 wherein the slurry is maintained at an elevated temperature in step (b) for a period of from 15 to 60 minutes.

11. A process as claimed in claim 1 wherein a rate of heating the slurry is maintained at a rate of less than 2° C. per minute in the temperature range of 150° C. to 250° C.

12. A process as claimed in claim 1 wherein the slurry in step (b) is maintained at the autogenous pressure of the heated slurry to prevent the slurry from boiling.

13. A process as claimed in claim 1 wherein step (c) takes place at a temperature of from 30° C. to 80° C.

14. A process as claimed in claim 13 wherein the slurry from step (b) is cooled to a temperature of from 30-80 C. at a cooling rate of less than 20° C./minute and at 2 C. per minute whilst the temperature of the slurry is in the range of 240° C. -150° C.

15. A process as claimed in claim 1 wherein the alkalized coal recovered from step (c) is washed to remove excess alkali.

16. A process as claimed in claim 1 wherein the alkalized coal from step (c) is treated to remove sodium aluminosilicates therefrom prior to sending to step (d).

17. A process as claimed in claim 1 wherein step (d) comprises mixing the coal from step (c) with water or an acid solution to obtain a slurry having a coal concentration that falls within the range of 5% to 20% by weight.

18. A process as claimed in claim 17 wherein the slurry has a coal concentration of about 10% by weight.

19. A process as claimed in claim 1 wherein the slurry in step (d) contains a mineral acid.

20. A process as claimed in claim 19 wherein the mineral acid is sulphuric acid or hydrochloric acid.

21. A process as claimed in claim 1 wherein the slurry of step (d) has a pH that falls in the range of 0.5 to 1.5.

22. A process as claimed in claim 21 wherein the pH of the slurry is about 1.0.

23. A process as claimed in claim 1 wherein the temperature of the slurry in step (d) falls within the range from 20° C. to 90° C.

24. A process as claimed in claim 23 wherein the temperature falls within the range of from 30° C. to 60° C.

25. A process as claimed in claim 1 wherein the coal is maintained in contact with the acid solution in step (d) for a period of at least 1 minute.

26. A process as claimed in claim 25 wherein the coal is maintained in contact with the acid solution in step (d) for a period of about 60 minutes.

27. A process as claimed in claim 1 wherein the coal fraction from step (e) is re-slurried with water and acid and brought to a pH of between 0.5 and 1.0 for a further period of time of greater than 1 minute.

28. A process as claimed in claim 27 wherein the step of re-slurrying the coal is repeated between one and four times.

29. A process as claimed in claim 1 wherein step (f) comprises mixing the coal-containing fraction with a solution of water and a polar organic solvent that is an alcohol selected from ethanol, methanol, propanol or mixtures thereof.

30. A process as claimed in claim 29 wherein the polar organic solvent is ethanol.

31. A process as claimed in claim 1 wherein the mixture of step (f) comprises water and a polar organic solvent and has a solids content of 10-30% by weight.

32. A process as claimed in claim 31 wherein the mixture in step (f) has a pH of from 1.5 to 2.5.

33. A process as claimed in claim 29 wherein the mixture in step (f) is heated to a temperature of from 240° C. to 280° C.

34. A process as claimed in claim 33 wherein the mixture in step (f) is heated at a heating rate of between 2° C. per minute and 20° C. per minute.

35. A process as claimed in claim 1 wherein the citric acid is added to the coal-containing fraction as a citric acid solution containing between 5% and 20% by weight citric acid (hydrated basis).

36. A process as claimed in claim 35 wherein the mixture in step (f) is heated to a temperature of between 240° C. to 280° C.

37. A process as claimed in claim 35 wherein the mixture in step (f) is heated to a temperature of between 150° C. and 160° C.

38. A process as claimed in claim 36 wherein the mixture in step (f) is heated to the elevated temperature at a heating rate of between 2° C. per minute and 20° C. per minute.

39. A process as claimed in claim 1 wherein the coal containing portion from step (g) is washed with water.

40. A process as claimed in claim 1 wherein coal containing portion from step (g) has an ash content of from 0.01-0.2%, by weight.

41. A process as claimed in claim 1 wherein the spent alkali leachant from step (c) is treated to regenerate caustic and to recover minerals.

42. A process as claimed in claim 41 wherein the spent alkali leachant is treated by mixing with one or more of calcium oxide, calcium hydroxide, magnesium oxide, magnesium hydroxide, or mixed oxides or hydroxide of calcium and magnesium derived from dolomite to precipitate soluble silicate and aluminate ions and from soluble sodium hydroxide.

43. A process as claimed in claim 1 wherein the substantially liquid fraction of step (e) is treated to regenerate a caustic solution and to recover minerals.

44. A process as claimed in claim 43 wherein the substantially liquid fraction is mixed with one or more of calcium oxide, calcium hydroxide, magnesium oxide, magnesium hydroxide, or mixed oxides or hydroxide of calcium and magnesium derived from dolomite.

* * * * *